US011299792B2

(12) United States Patent
Kim et al.

(10) Patent No.: US 11,299,792 B2
(45) Date of Patent: Apr. 12, 2022

(54) NON-ORIENTED ELECTRICAL STEEL SHEET AND MANUFACTURING METHOD THEREFOR

(71) Applicant: POSCO, Pohang-si (KR)

(72) Inventors: Jae-Hoon Kim, Pohang-si (KR); Jong Uk Ryu, Pohang-si (KR); Seung Il Kim, Pohang-si (KR); Sin Young Jung, Pohang-si (KR); Su Yong Sin, Pohang-si (KR); Sang Woo Lee, Pohang-si (KR)

(73) Assignee: POSCO, Pohang-si (KR)

( * ) Notice: Subject to any disclaimer, the term of this patent is extended or adjusted under 35 U.S.C. 154(b) by 407 days.

(21) Appl. No.: 15/539,629

(22) PCT Filed: Dec. 21, 2015

(86) PCT No.: PCT/KR2015/014047
§ 371 (c)(1),
(2) Date: Jun. 23, 2017

(87) PCT Pub. No.: WO2016/105058
PCT Pub. Date: Jun. 30, 2016

(65) Prior Publication Data

US 2017/0362677 A1 Dec. 21, 2017

(30) Foreign Application Priority Data

Dec. 24, 2014 (KR) ..... 10-2014-0189079
Dec. 24, 2014 (KR) ..... 10-2014-0189080

(51) Int. Cl.

| | |
|---|---|
| ***C21D 9/46*** | (2006.01) |
| ***C22C 38/02*** | (2006.01) |
| ***C22C 38/12*** | (2006.01) |
| ***C22C 38/14*** | (2006.01) |
| ***C21D 8/12*** | (2006.01) |
| ***C22C 38/00*** | (2006.01) |
| ***C21D 6/00*** | (2006.01) |
| ***C22C 38/04*** | (2006.01) |
| ***C22C 38/06*** | (2006.01) |
| ***C22C 38/60*** | (2006.01) |

(52) U.S. Cl.
CPC ..... *C21D 9/46* (2013.01); *C21D 6/008* (2013.01); *C21D 8/125* (2013.01); *C21D 8/1216* (2013.01); *C21D 8/1222* (2013.01); *C21D 8/1233* (2013.01); *C21D 8/1261* (2013.01); *C22C 38/00* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C22C 38/60* (2013.01); *C21D 8/1272* (2013.01)

(58) Field of Classification Search
CPC ..... C21D 6/008; C21D 8/125; C22C 38/004; C22C 38/008; C22C 38/02; C22C 38/14; C22C 38/60
See application file for complete search history.

(56) References Cited

U.S. PATENT DOCUMENTS

2015/0013844 A1* 1/2015 Xie ..... C21C 7/068 148/111

FOREIGN PATENT DOCUMENTS

| | | | | |
|---|---|---|---|---|
| CN | 1225396 | A | | 8/1999 |
| CN | 102912103 | A | | 2/2013 |
| CN | WO2013127048 | | * | 9/2013 |
| JP | H06-10048 | A | | 1/1994 |
| JP | H10-317111 | A | | 12/1998 |
| JP | 2000-104114 | A | | 4/2000 |
| JP | 2000-129409 | A | | 5/2000 |
| JP | 2001-98329 | A | | 4/2001 |
| JP | 2001-123252 | A | | 5/2001 |
| JP | 2004-332031 | A | | 11/2004 |
| JP | 2005-200755 | A | | 7/2005 |
| JP | 2005-206887 | A | | 8/2005 |
| JP | 2005-344156 | A | | 12/2005 |
| JP | 2010-024509 | A | | 2/2010 |
| JP | 2011-006721 | A | | 1/2011 |
| JP | 2011-022810 | A | | 2/2011 |
| JP | 2011-119298 | A | | 6/2011 |
| JP | 2012-036474 | A | | 2/2012 |
| JP | 2013-044010 | A | | 3/2013 |
| JP | 2013044010 | | * | 3/2013 |
| KR | 10-1999-0063311 | A | | 7/1999 |
| KR | 10-2011-0127271 | A | | 11/2011 |
| KR | 10-2014-0123582 | A | | 10/2014 |

(Continued)

OTHER PUBLICATIONS

Extended European Search Report dated Feb. 12, 2018 issued in European Patent Application No. 15873585.2.

(Continued)

*Primary Examiner* — Nicholas A Wang

(74) *Attorney, Agent, or Firm* — Morgan, Lewis & Bockius LLP

(57) ABSTRACT

A non-oriented electrical steel sheet according to an embodiment of the present invention includes Ti at 0.0030 wt % or less (excluding 0 wt %), Nb at 0.0035 wt % or less (excluding 0 wt %), V at 0.0040 wt % or less (excluding 0 wt %), B at 0.0003 wt % to 0.0020 wt %, and the remaining portion including Fe and other inevitably added impurities, wherein a value of ([Ti]+0.8[Nb]+0.5[V])/(10*[B]) may be 0.17 to 7.8.

4 Claims, No Drawings

(56) References Cited

FOREIGN PATENT DOCUMENTS

WO 2013/127048 A1 9/2013

OTHER PUBLICATIONS

Written Opinion and International Search Report dated Mar. 22, 2016 issued in International Patent Application No. PCT/KR2015/014047 (with partial English translation).
Supplementary European Search Report dated Sep. 29, 2017 issued in European Patent Application No. 15873585.2.

* cited by examiner

NON-ORIENTED ELECTRICAL STEEL SHEET AND MANUFACTURING METHOD THEREFOR

CROSS REFERENCE

This patent application is the U.S. National Phase under 35 U.S.C. § 371 of International Application No. PCT/KR2015/014047, filed on Dec. 21, 2015, which claims the benefit of Korean Patent Application No. 10-2014-0189079, filed on Dec. 24, 2014 and Korean Patent Application No. 10-2014-0189080, filed on Dec. 24, 2014, the entire contents of each are hereby incorporated by reference.

TECHNICAL FIELD

The present invention relates to a non-oriented electrical steel sheet and a manufacturing method therefor.

BACKGROUND ART

A non-oriented electrical steel sheet is an important material in determining energy efficiency of electrical devices because it is used as a material for an iron core in rotating devices such as motors and generators and stationary devices such as small transformers, and the iron core serves to convert electrical energy into mechanical energy. Magnetic properties of the electrical steel sheet include iron loss and magnetic flux density, and since the iron loss corresponds to energy loss, the lower the core loss, the better. Meanwhile, when the electrical steel sheet has high magnetic flux density with an easy magnetization characteristic, since the same magnetic flux density is generated even when a relatively smaller amount of current is applied thereto, copper loss corresponding to heat generated by the wound copper wire may be reduced, and therefore, the higher the magnetic flux density, the better. In order to improve the iron loss among magnetic properties of the non-oriented electrical steel sheet, a method of adding Si, Al, Mn, or the like that is an alloy element having high specific resistance, is generally used for increasing electrical resistance. However, when the alloy element is added, the iron loss is reduced, but the magnetic flux density is also reduced due to a decrease of saturation magnetic flux density. Particularly, when a large amount of silicon (Si) and aluminum (Al) is increased, workability is lowered, which makes it difficult to perform cold rolling, resulting in deterioration in productivity and a increase in hardness, and the increase of the hardness lowers the workability. In order to improve texture related to this, it is known that a method of adding a trace amount of the alloy element is effective. Through the method, it is possible to manufacture a clean steel by reducing a fraction of grains parallel to a <111> axis in a direction perpendicular to a sheet surface that corresponds to a harmful texture or significantly reducing an amount of impurities. However, since the above-mentioned technologies increase manufacturing costs and cause difficulty in mass production, an excellent technique for improving the magnetic property without significantly increasing the manufacturing costs is required.

DISCLOSURE

Technical Problem

An exemplary embodiment of the present invention provides a non-oriented electrical steel sheet.

Another exemplary embodiment of the present invention provides a manufacturing method of a non-oriented electrical steel sheet.

Technical Solution

An exemplary embodiment of the present invention provides a non-oriented electrical steel sheet including, based on 100 wt % of a total composition thereof, Ti at 0.0030 wt % or less (excluding 0 wt %), Nb at 0.0035 wt % or less (excluding 0 wt %), V at 0.0040 wt % or less (excluding 0 wt %), B at 0.0003 wt % to 0.0020 wt %, and the remaining portion including Fe and impurities, wherein a value of ([Ti]+0.8[Nb]+0.5[V])/(10*[B]) may be 0.17 to 7.8.

A grain size of the electrical steel sheet may be 60 μm to 95 μm.

The electrical steel sheet, based on 100 wt % of a total composition thereof, may further include C at 0.004 wt % or less (excluding 0 wt %), Si at 2.5 wt % to 3.5 wt %, Al at 0.5 wt % to 1.8 wt %, Mn at 0.05 wt % to 0.9 wt %, N at 0.0030 wt % or less (excluding 0 wt %), and S at 0.0030 wt % or less (excluding 0 wt %).

When a rolling direction of the electrical steel sheet corresponds to an x-axis, a width direction thereof corresponds to a y-axis, and a normal direction of an xy plane thereof corresponds to a z-axis, a value of (a length of the grain in the y-axis direction)/(a length of the grain in the z-axis direction) measured on a yz plane may be 1.5 or less.

In the electrical steel sheet, the number of inclusions including Ti, Nb, V, and B may be 500/mm$^2$ or less.

The electrical steel sheet, based on 100 wt % of a total composition thereof, may further include P at 0.005 wt % to 0.08 wt %, Sn at 0.01 wt % to 0.08 wt %, Sb at 0.005 wt % to 0.05 wt %, or a combination thereof, and [P]+[Sn]+[Sb] may be 0.01 wt % to 0.1 wt %.

Another embodiment of the present invention provides a manufacturing method of a non-oriented electrical steel sheet, including: heating a slab, based on 100 wt % of a total composition thereof, including Ti at 0.0030 wt % or less (excluding 0 wt %), Nb at 0.0035 wt % or less (excluding 0 wt %), V at 0.0040 wt % or less (excluding 0 wt %), B at 0.0003 wt % to 0.0020 wt %, and the remaining portion including Fe and impurities, wherein a value of ([Ti]+0.8[Nb]+0.5[V])/(10*[B]) is 0.17 to 7.8, and then hot rolling it to prepare a hot-rolled steel sheet; cold rolling the hot-rolled steel sheet to prepare a cold-rolled steel sheet; and annealing the cold-rolled steel sheet.

Herein, [Ti], [Nb], [V], and [B] represent an addition amount (wt %) of Ti, Nb, V, and B, respectively.

The slab, based on 100 wt % of a total composition thereof, may further include C at 0.004 wt % or less (excluding 0 wt %), Si at 2.5 wt % to 3.5 wt %, Al at 0.5 wt % to 1.8 wt %, Mn at 0.05 wt % to 0.9 wt %, N at 0.0030 wt % or less (excluding 0 wt %), and S at 0.0030 wt % or less (excluding 0 wt %).

The manufacturing method of the non-oriented electrical steel sheet may further include annealing the hot-rolled steel sheet, wherein an annealing temperature of the hot-rolled steel sheet may be 850° C. to 1150° C.

An annealing temperature in the annealing of the cold-rolled steel sheet may be 950° C. to 1150° C.

The annealing of the cold-rolled steel sheet may be performed in a state in which a tension of 0.6 kgf/mm$^2$ or less is applied thereto.

The applied tension may be 0.2 kgf/mm$^2$ to 0.6 kgf/mm$^2$.

The slab, based on 100 wt % of a total composition thereof, may further include P at 0.005 wt % to 0.08 wt %, Sn at 0.01 wt % to 0.08 wt %, Sb at 0.005 wt % to 0.05 wt %, or a combination thereof, and [P]+[Sn]+[Sb] may be 0.01 wt % to 0.1 wt %.

Advantageous Effects

According to the embodiment of the present invention, it is possible to provide a non-oriented electrical steel sheet having low iron loss and excellent magnetic flux density.

MODE FOR INVENTION

The advantages and features of the present invention and the methods for accomplishing the same will be apparent from the exemplary embodiments described hereinafter with reference to the accompanying drawings. However, the present invention is not limited to the exemplary embodiments described hereinafter, and may be embodied in many different forms. The following exemplary embodiments are provided to make the disclosure of the present invention complete and to allow those skilled in the art to clearly understand the scope of the present invention, and the present invention is defined only by the scope of the appended claims. Throughout the specification, the same reference numerals denote the same constituent elements.

In some exemplary embodiments, detailed description of well-known technologies will be omitted to prevent the disclosure of the present invention from being interpreted ambiguously. Unless otherwise defined, all terms (including technical and scientific terms) used herein have the same meaning as commonly understood by one of ordinary skill in the art. In addition, throughout the specification, unless explicitly described to the contrary, the word "comprise" and variations such as "comprises" or "comprising" will be understood to imply the inclusion of stated elements but not the exclusion of any other elements. Further, as used herein, the singular forms "a", "an", and "the" are intended to include the plural forms as well, unless the context clearly indicates otherwise.

Further, as used herein, % means wt %, unless the context clearly indicates otherwise.

Hereinafter, a manufacturing method of a non-oriented electrical steel sheet according to an embodiment of the present invention will be described.

A slab is heated and then hot rolled to manufacture a hot-rolled steel sheet.

The slab may include Ti at 0.0030 wt % or less (excluding 0 wt %), Nb at 0.0035 wt % or less (excluding 0 wt %), V at 0.0040 wt % or less (excluding 0 wt %), B at 0.0003 wt % to 0.0020 wt %, and the remaining portion including Fe and other inevitably added impurities.

A value of ([Ti]+0.8[Nb]+0.5[V])/(10*[B]) may be 0.17 to 7.8. Herein, [Ti], [Nb], [V], and [B] represent an addition amount (wt %) of Ti, Nb, V, and B, respectively.

The slab may further include C at 0.004 wt % or less (excluding 0 wt %), Si at 2.5 wt % to 3.5 wt %, Al at 0.5 wt % to 1.8 wt %, Mn at 0.05 wt % to 0.9 wt %, N at 0.0015 wt % to 0.0030 wt %, and S at 0.0030 wt % or less.

The slab may include P at 0.005 wt % to 0.08 wt %, Sn at 0.01 wt % to 0.08 wt %, Sb at 0.005 wt % to 0.05 wt %, or a combination thereof, and [P]+[Sn]+[Sb] may be 0.01 wt % to 0.1 wt %. Herein, [P], [Sn], and [Sb] represent an addition amount (wt %) of P, Sn, and Sb, respectively.

A reason of limiting the composition of the slab will now be described.

When C is more than 0.004 wt %, magnetic aging may occur.

Si serves to reduce iron loss by increasing specific resistance. When a content of Si is less than 2.5 wt %, an effect of improving the iron loss is insufficient, while when it exceeds 3.5 wt %, hardness is increased, thereby deteriorating productivity and a punching property.

Al serves to reduce iron loss by increasing specific resistance. When a content of Al is less than 0.5 wt %, since there is no effect of reducing critical high frequency iron loss, a nitride may be finely formed to deteriorate magnetism, while when it exceeds 1.8 wt %, magnetic flux density may be deteriorated, thereby deteriorating productivity in steel making and continuous casting.

Mn serves to improve iron loss and to form a sulfide by increasing specific resistance. When a content of Mn is less than 0.05 wt %, MnS may be finely precipitated to deteriorate magnetism, while when it exceeds 0.9 wt %, [111] texture may be formed to deteriorate magnetism.

When a content of N is more than 0.0030 wt %, it may be combined with Ti, Nb, and V to form a nitride, thereby suppressing growth of grains and mobility of magnetic domains. Accordingly, in the embodiment of the present invention, although N may not be added, since there is some amount that is inevitably incorporated during the steelmaking process, 0.0015 wt % or more of N may be added.

P serves to improve specific resistance of a material and to improve magnetism by being segregated in grain boundaries to improve texture. When less than 0.005 wt % of P is added, there is no effect of improving the texture, while when P exceeds 0.08 wt %, segregation at the grain boundaries will be excessive, thus the rolling property and punching property may deteriorate.

Sn may improve the texture to improve magnetism. When an added amount of Sn is less than 0.01 wt %, there is no effect of improving the magnetism, while when it exceeds 0.08 wt %, the grain boundaries may be weakened, and trace inclusions may be formed to deteriorate the magnetism.

Sb may improve the texture to improve magnetism. When an added amount of Sb is less than 0.005 wt %, there is no effect of improving the magnetism, while when it exceeds 0.05 wt %, the grain boundaries may be weakened, and trace inclusions may be formed to deteriorate the magnetism.

When a content of [P]+[Sn]+[Sb] is less than 0.01 wt %, there is no effect of improving the magnetism, while when it exceeds 0.1 wt %, since an amount segregated at the grain boundaries increases, growth of the grains may deteriorate, and [111] texture may be formed to deteriorate magnetism.

When S is more than 0.0030 wt %, a trace sulfide is formed to inhibit grain growth, thereby deteriorating iron loss.

When an added amount of Ti is more than 0.0030 wt %, a trace nitride may be formed to deteriorate the growth of the grains.

When an added amount of Nb is more than 0.0035 wt %, a trace nitride may be formed to deteriorate the growth of the grains.

When an added amount of V is more than 0.0040 wt %, a trace nitride may be formed to deteriorate the growth of the grains.

When a content of B is less than 0.0003 wt %, a trace nitride is formed to deteriorate magnetism, while when it exceeds 0.0020 wt %, the remaining B that does not form the nitride may prevent movement of the magnetic domains, thereby deteriorating magnetism.

In addition, when ([Ti]+0.8[Nb]++0.5[V])/(10*[B]) is less than 0.17 or more than 7.8, the inclusions are not coarsely formed, thus magnetism of the electrical steel sheet may deteriorate, and the [111] texture that is undesirable for magnetism may be formed.

The described slab is heated. A temperature of heating the slab may be 1100° C. to 1250° C. When the heating of the slab is completed, the slab is hot-rolled to prepare a hot-rolled steel sheet. A final rolling of the hot rolling may be performed at 800° C. or higher.

The hot-rolled steel sheet, as necessary, is annealed at a temperature of 850° C. to 1150° C. to increase crystal orientation that is desirable for magnetism. When a temperature for annealing the hot-rolled steel sheet is less than 850° C., since a structure thereof does not grow or finely grows, a synergistic effect of the magnetic flux density is small, while when the temperature exceeds 1150° C., magnetic properties thereof may deteriorate and plate-shaped deformation may occur. Specifically, the temperature for annealing the hot-rolled steel sheet may be 950° C. to 1150° C. Next, after the hot-rolled steel sheet is pickled, it is cold-rolled at a reduction ratio of 70% to 95% to prepare a cold-rolled steel sheet.

The cold-rolled steel sheet is annealed. A temperature for annealing the cold-rolled steel sheet may be 950° C. to 1150° C. When the temperature for annealing the cold-rolled steel sheet is less than 950° C., recrystallization does not sufficiently occur, while when it exceeds 1050° C., a size of the grain increases, thus high-frequency iron loss may deteriorate.

While the cold-rolled steel sheet is annealed, the grains grow, and it is possible for a size of the grains to be 60 μm to 95 μm by controlling the cold-rolled steel sheet annealing temperature and the cold-rolled steel sheet annealing time. When the size of the grains is less than 60 μm, since recrystallization does not sufficiently occur, magnetism is not improved, while when it exceeds 95 μm, since the grains excessively grow, magnetism may deteriorate at a high frequency.

The annealing of the cold-rolled steel sheet may be performed in a state in which tension is applied to the steel sheet by a winding roll.

The tension applied to the steel sheet may be 0.6 kgf/mm$^2$ or less. By controlling a ratio of sizes of the grains through the annealing of the cold-rolled steel sheet in the state in which the tension is applied to the steel sheet, it is possible to improve magnetism of the electrical steel sheet. Further, when the applied tension is more than 0.6 kgf/mm$^2$, the grains may be excessively deformed to deteriorate magnetism. When the applied tension is less than 0.2 kgf/mm$^2$, improvement of the magnetism due to deformation of the grains may become difficult.

Hereinafter, a non-oriented electrical steel sheet according to an embodiment of the present invention will be described.

A non-oriented electrical steel sheet according to an embodiment of the present invention includes Ti at 0.0030 wt % or less (excluding 0 wt %), Nb at 0.0035 wt % or less (excluding 0 wt %), V at 0.0040 wt % or less (excluding 0 wt %), B at 0.0003 wt % to 0.0020 wt %, and the remaining portion including Fe and other inevitably added impurities, and a value of ([Ti]+0.8[Nb]+0.5[V])/(10*[B]) may be 0.17 to 7.8.

The electrical steel sheet may further include C at 0.004 wt % or less (excluding 0 wt %), Si at 2.5 wt % to 3.5 wt %, Al at 0.5 wt % to 1.8 wt %, Mn at 0.05 wt % to 0.9 wt %, N at 0.0030 wt % or less (excluding 0 wt %), and S at 0.0030 wt % or less (excluding 0 wt %). A reason for limiting components of the non-oriented electrical steel sheet is the same as for limiting those of the slab. A size of the grains of the electrical steel sheet may be 60 μm to 95 μm.

In the non-oriented electrical steel sheet according to the exemplary embodiment of the present invention, when a rolling direction of the steel sheet corresponds to an x-axis, a width direction thereof corresponds to a y-axis, and a normal direction of an xy plane thereof corresponds to a z-axis, a value of (a length of the grain in the y-axis direction)/(a length of the grain in the z-axis direction) measured on a yz plane may be 1.5 or less. The size of the grains is changed due to the tension applied while the cold-rolled steel sheet is annealed, and in this case, when the value of (the length of the grain in the y-axis direction)/(the length of the grain in the z-axis direction) is more than 1.5, the grains may be excessively deformed to deteriorate magnetism. The value of (the length of the grain in the y-axis direction)/(the length of the grain in the z-axis direction) may be 1.18 or more. When the value of (the length of the grain in the y-axis direction)/(the length of the grain in the z-axis direction) is less than 1.18, the improvement of magnetism by the deformation of the grain may be difficult.

In addition, the electrical steel sheet includes P at 0.005 wt % to 0.08 wt %, Sn at 0.01 wt % to 0.08 wt %, Sb at 0.005 wt % to 0.05 wt %, or a combination thereof, and [P]+[Sn]+[Sb] may be 0.01 wt % to 0.1 wt %. Herein, [P], [Sn], and [Sb] represent an addition amount (wt %) of P, Sn, and Sb, respectively.

In the electrical steel sheet, the number of inclusions including Ti, Nb, V, and B may be 500/mm$^2$ or less. Specifically, they may be 5/mm$^2$ or less. When the number of inclusions is more than 5/mm$^2$, the number of inclusions may be excessive to deteriorate magnetism.

Hereinafter, examples will be described in detail. However, the following examples are illustrative of the present invention, so the present invention is not limited thereto.

EXAMPLE 1

A slab including the components as shown in Table 1 was prepared (in Table 1, % corresponds to wt %). Next, the slab was heated to 1150° C. and then hot rolled. Final rolling of the hot rolling was performed at 850° C. to prepare a hot-rolled steel sheet having a thickness of 2.0 mm.

Next, the hot-rolled steel sheet was annealed at 1100° C. for 4 minutes and then pickled.

Subsequently, it was cold rolled to prepare a cold-rolled steel sheet having a thickness of 0.35 mm.

Next, the cold-rolled steel sheet was annealed for 40 seconds under the conditions shown in Table 2.

TABLE 1

| Steel type | Si (%) | Al (%) | Mn (%) | Ti (%) | Nb (%) | V (%) | B (%) | C (%) | S (%) | N (%) |
|---|---|---|---|---|---|---|---|---|---|---|
| A1 | 3.1 | 0.9 | 0.5 | 0.0005 | 0.0005 | 0.001 | 0.001 | 0.0025 | 0.0025 | 0.0018 |
| A2 | 3.1 | 0.9 | 0.5 | 0.003 | 0.0005 | 0.0025 | 0.0003 | 0.003 | 0.0024 | 0.0018 |
| A3 | 3.1 | 0.9 | 0.5 | 0.0025 | 0.0025 | 0.003 | 0.001 | 0.002 | 0.0018 | 0.002 |
| A4 | 3.1 | 0.9 | 0.5 | 0.0015 | 0.0025 | 0.003 | 0.001 | 0.0018 | 0.0022 | 0.0019 |
| A5 | 3.1 | 0.9 | 0.5 | 0.0025 | 0.0025 | 0.003 | 0.0025 | 0.0025 | 0.0025 | 0.002 |
| B1 | 3.4 | 0.6 | 0.5 | 0.001 | 0.0005 | 0.001 | 0.0015 | 0.0025 | 0.002 | 0.002 |
| B2 | 3.4 | 0.6 | 0.5 | 0.0025 | 0.0025 | 0.003 | 0.0003 | 0.0022 | 0.0015 | 0.0018 |
| B3 | 3.4 | 0.6 | 0.5 | 0.0025 | 0.0025 | 0.003 | 0.001 | 0.0021 | 0.0018 | 0.0016 |
| B4 | 3.4 | 0.6 | 0.5 | 0.0035 | 0.0025 | 0.003 | 0.001 | 0.0018 | 0.0025 | 0.0017 |
| B5 | 3.4 | 0.6 | 0.5 | 0.0025 | 0.0025 | 0.003 | 0.0025 | 0.0025 | 0.0025 | 0.002 |
| C1 | 2.8 | 1.2 | 0.5 | 0.0005 | 0.001 | 0.0015 | 0.002 | 0.0025 | 0.0022 | 0.002 |
| C2 | 2.8 | 1.2 | 0.5 | 0.0025 | 0.0025 | 0.003 | 0.0003 | 0.003 | 0.0022 | 0.0019 |
| C3 | 2.8 | 1.2 | 0.5 | 0.0025 | 0.0025 | 0.003 | 0.001 | 0.0024 | 0.0025 | 0.002 |
| C4 | 2.8 | 1.2 | 0.5 | 0.0025 | 0.0025 | 0.003 | 0.0015 | 0.0018 | 0.0017 | 0.0018 |
| C5 | 2.8 | 1.2 | 0.5 | 0.0025 | 0.0025 | 0.003 | 0.0025 | 0.0025 | 0.0018 | 0.0016 |

TABLE 2

| Steel type | (Ti + 0.8 Nb + 0.5 V)/10 B (%) | Thickness mm | Cold-rolled steel sheet annealing temperature ° C. | Grain diameter μm | W15/50 W/kg | W10/400 W/kg | B50 T | Remark |
|---|---|---|---|---|---|---|---|---|
| A1 | 0.14 | 0.35 | 990 | 58 | 2.3 | 17.5 | 1.65 | Comparative Example |
| A2 | 1.55 | 0.35 | 970 | 80 | 2.1 | 16 | 1.67 | Inventive Example |
| A3 | 0.6 | 0.35 | 960 | 78 | 2.2 | 16.5 | 1.67 | Inventive Example |
| A4 | 0.5 | 0.35 | 980 | 85 | 2.2 | 16.2 | 1.66 | Inventive Example |
| A5 | 0.24 | 0.35 | 1000 | 60 | 2.4 | 17.8 | 1.65 | Comparative Example |
| B1 | 0.1266667 | 0.35 | 990 | 77 | 2.3 | 17.2 | 1.65 | Comparative Example |
| B2 | 2 | 0.35 | 970 | 85 | 2 | 16 | 1.66 | Inventive Example |
| B3 | 0.6 | 0.35 | 960 | 80 | 2.1 | 16.3 | 1.66 | Inventive Example |
| B4 | 0.7 | 0.35 | 980 | 58 | 2.3 | 17.5 | 1.65 | Comparative Example |
| B5 | 0.24 | 0.35 | 1000 | 65 | 2.3 | 17.9 | 1.65 | Comparative Example |
| C1 | 0.1025 | 0.35 | 990 | 62 | 2.3 | 17.2 | 1.65 | Comparative Example |
| C2 | 2 | 0.35 | 970 | 85 | 2 | 16.2 | 1.67 | Inventive Example |
| C3 | 0.6 | 0.35 | 960 | 72 | 2 | 16.2 | 1.67 | Inventive Example |
| C4 | 0.4 | 0.35 | 980 | 78 | 2.1 | 16 | 1.67 | Inventive Example |
| C5 | 0.24 | 0.35 | 1000 | 58 | 2.3 | 17.9 | 1.65 | Comparative Example |

In cases of A2 to A4, B2, B3, and C2 to C4 corresponding to steel types included in the embodiment of the present invention, since the growth of grains was good, even though the final annealing was performed at a relatively low temperature, the size of the grains increased to obtain the non-oriented electrical steel sheet having excellent magnetism. However, unlike the examples of the present invention, since the growth of the grains of the remaining steel types deteriorated, the grains of the remaining steel types were smaller than those of the inventive examples final-annealed at the similar temperature, and the magnetism thereof deteriorated.

EXAMPLE 2

A slab including the components as shown in Table 3 was prepared. Next, the slab was heated to 1150° C. and then hot rolled. A final rolling of the hot rolling was performed at 850° C. to prepare a hot-rolled steel sheet having a thickness of 2.0 mm.

Next, the hot-rolled steel sheet was annealed at 1100° C. for 4 minutes and then pickled.

Subsequently, it was cold rolled to prepare a cold-rolled steel sheet having a thickness shown in Table 4.

Next, the cold-rolled steel sheet was annealed at 970° C. for 35 seconds.

TABLE 3

| Steel type | Si (%) | Al (%) | Mn (%) | P (%) | Sn (%) | Sb (%) | Ti (%) | Nb (%) | V (%) | B (%) | C (%) | S (%) | N (%) |
|---|---|---|---|---|---|---|---|---|---|---|---|---|---|
| D1 | 3.1 | 0.9 | 0.3 | 0.03 | 0.03 | 0.03 | 0.0007 | 0.0008 | 0.0012 | 0.0012 | 0.0021 | 0.0018 | 0.0019 |
| D2 | 3.1 | 0.9 | 0.3 | 0.03 | 0.03 | 0.03 | 0.0025 | 0.0025 | 0.003 | 0.001 | 0.0019 | 0.0017 | 0.0016 |
| D3 | 3.1 | 0.9 | 0.3 | 0.03 | 0.03 | 0.03 | 0.0015 | 0.0025 | 0.003 | 0.001 | 0.0016 | 0.0021 | 0.0018 |
| D4 | 3.1 | 0.9 | 0.3 | 0.03 | 0.03 | 0.03 | 0.0025 | 0.0025 | 0.003 | 0.0025 | 0.0021 | 0.0025 | 0.0019 |
| D5 | 3.1 | 0.9 | 0.3 | 0.03 | 0.01 | 0.01 | 0.0015 | 0.0015 | 0.0015 | 0.0005 | 0.0015 | 0.0015 | 0.0015 |
| D6 | 3.1 | 0.9 | 0.3 | 0.01 | 0.01 | 0.03 | 0.0018 | 0.002 | 0.0016 | 0.0003 | 0.0021 | 0.0018 | 0.0019 |
| D7 | 3.1 | 0.9 | 0.3 | 0.03 | 0.03 | 0.03 | 0.0022 | 0.0017 | 0.0018 | 0.0007 | 0.0018 | 0.0019 | 0.002 |
| D8 | 3.1 | 0.9 | 0.3 | 0.05 | 0.05 | 0.05 | 0.0016 | 0.002 | 0.002 | 0.0006 | 0.0016 | 0.0022 | 0.0017 |
| D9 | 3.1 | 0.9 | 0.3 | 0.01 | 0.01 | 0.07 | 0.0018 | 0.0017 | 0.0019 | 0.0008 | 0.0022 | 0.0025 | 0.0019 |
| E1 | 3.4 | 0.6 | 0.3 | 0.03 | 0.02 | 0.01 | 0.0015 | 0.0015 | 0.0015 | 0.0004 | 0.0015 | 0.0015 | 0.0015 |
| E2 | 3.4 | 0.6 | 0.3 | 0.01 | 0.03 | 0.01 | 0.0017 | 0.002 | 0.0015 | 0.0003 | 0.0025 | 0.002 | 0.0017 |
| E3 | 3.4 | 0.6 | 0.3 | 0.05 | 0.05 | 0.05 | 0.0016 | 0.002 | 0.002 | 0.0005 | 0.0016 | 0.0022 | 0.0017 |

In Table 3, % corresponds to wt %.

TABLE 4

| Steel type | (Ti + 0.8 Nb + 0.5 V)/10 B (%) | Thickness mm | Grain diameter μm | W15/50 W/kg | W10/400 W/kg | B50 T | Remark |
|---|---|---|---|---|---|---|---|
| D1 | 0.161667 | 0.3 | 67 | 2.05 | 14.5 | 1.65 | Comparative Example |
| D2 | 0.6 | 0.3 | 80 | 1.98 | 13.5 | 1.67 | Inventive Example |
| D3 | 0.5 | 0.3 | 89 | 1.96 | 13.2 | 1.68 | Inventive Example |
| D4 | 0.24 | 0.3 | 52 | 2.11 | 15.3 | 1.65 | Comparative Example |
| D5 | 0.69 | 0.27 | 84 | 1.95 | 12.8 | 1.68 | Inventive Example |
| D6 | 1.4 | 0.27 | 87 | 1.91 | 13.1 | 1.67 | Inventive Example |
| D7 | 0.637143 | 0.27 | 79 | 1.92 | 12.7 | 1.67 | Inventive Example |
| D8 | 0.7 | 0.27 | 55 | 2.12 | 14.4 | 1.65 | Comparative Example |
| D9 | 0.51375 | 0.27 | 62 | 2.1 | 14.5 | 1.65 | Comparative Example |
| E1 | 0.8625 | 0.3 | 89 | 1.92 | 12.4 | 1.67 | Inventive Example |
| E2 | 1.35 | 0.3 | 93 | 1.95 | 12.6 | 1.67 | Inventive Example |
| E3 | 0.84 | 0.3 | 51 | 2.15 | 14.1 | 1.65 | Comparative Example |

In cases of steel types included in the embodiment of the present invention, the growth of grains was good, and P, Sn, and Sb were added together to improve a texture thereof, thus magnetism thereof was excellent. However, unlike the examples of the present invention, since the growth of the grains of the remaining steel types deteriorated, the grains of the remaining steel types were smaller than those of the inventive final-annealed examples at a similar temperature, and the magnetism thereof deteriorated.

EXAMPLE 3

A slab including the components as shown in Table 5 was heated, hot-rolled, annealed, and cold rolled in the same method as in Example 2.

Next, the cold-rolled steel sheet was annealed at 970° C. for 35 seconds, and in this case, the tension of the conditions as in Table 6 was applied thereto.

TABLE 5

| Steel type | Si (%) | Al (%) | Mn (%) | P (%) | Sn (%) | Sb (%) | Ti (%) | Nb (%) | V (%) | B (%) | C (%) | S (%) | N (%) |
|---|---|---|---|---|---|---|---|---|---|---|---|---|---|
| F1 | 2.8 | 1.2 | 0.3 | 0.01 | 0.03 | 0.03 | 0.0015 | 0.0015 | 0.002 | 0.0005 | 0.0025 | 0.002 | 0.002 |
| F2 | 2.8 | 1.2 | 0.3 | 0.01 | 0.03 | 0.03 | 0.0015 | 0.0015 | 0.002 | 0.0003 | 0.0021 | 0.0019 | 0.0018 |
| F3 | 2.8 | 1.2 | 0.3 | 0.01 | 0.03 | 0.03 | 0.0015 | 0.0015 | 0.002 | 0.0007 | 0.0016 | 0.0022 | 0.0015 |
| F4 | 2.8 | 1.2 | 0.3 | 0.01 | 0.03 | 0.03 | 0.0015 | 0.0015 | 0.002 | 0.0006 | 0.0016 | 0.0022 | 0.0017 |
| F5 | 2.8 | 1.2 | 0.3 | 0.01 | 0.03 | 0.03 | 0.0015 | 0.0015 | 0.002 | 0.0008 | 0.0018 | 0.0023 | 0.0019 |
| F6 | 2.8 | 1.2 | 0.3 | 0.01 | 0.03 | 0.03 | 0.0015 | 0.0015 | 0.002 | 0.0004 | 0.0015 | 0.0015 | 0.0015 |
| F7 | 2.8 | 1.2 | 0.3 | 0.01 | 0.03 | 0.03 | 0.0015 | 0.0015 | 0.002 | 0.0005 | 0.0016 | 0.0022 | 0.0017 |
| F8 | 2.8 | 1.2 | 0.3 | 0.01 | 0.03 | 0.03 | 0.0015 | 0.0015 | 0.002 | 0.0003 | 0.0015 | 0.002 | 0.0017 |

In Table 5, % corresponds to wt %.

TABLE 6

| Steel type | Thickness mm | Annealing temperature ° C. | Annealing tension kgf/mm$^2$ | Grain size mm | Length direction elongation ratio | Inclusion number number/mm$^2$ | W10/400 W/kg | W10/800 W/kg | (W10/400)/(W10/800) | B50 T | Remark |
|---|---|---|---|---|---|---|---|---|---|---|---|
| F1 | 0.25 | 980 | 0.8 | 82 | 1.54 | 5.6 | 12.1 | 35.9 | 0.337 | 1.65 | Comparative Example |
| F2 | 0.25 | 970 | 0.3 | 77 | 1.18 | 2.1 | 11.8 | 33.7 | 0.350 | 1.66 | Inventive Example |
| F3 | 0.25 | 990 | 1.2 | 90 | 1.58 | 8.4 | 12.3 | 36.6 | 0.336 | 1.64 | Comparative Example |
| F4 | 0.25 | 970 | 0.4 | 86 | 1.22 | 2.5 | 11.7 | 34.2 | 0.342 | 1.67 | Inventive Example |
| F5 | 0.20 | 980 | 1.1 | 76 | 1.53 | 8.9 | 11.2 | 32.1 | 0.349 | 1.61 | Comparative Example |
| F6 | 0.20 | 970 | 0.5 | 78 | 1.25 | 4.1 | 10.8 | 31.5 | 0.343 | 1.63 | Inventive Example |
| F7 | 0.20 | 990 | 0.2 | 82 | 1.19 | 3.8 | 10.5 | 30.8 | 0.341 | 1.64 | Inventive Example |
| F8 | 0.20 | 990 | 0.8 | 85 | 1.55 | 5.7 | 11.3 | 32.5 | 0.348 | 1.61 | Comparative Example |

In Table 6, the length direction elongation ratio, when the rolling direction of the steel sheet corresponds to the x-axis, the width direction thereof corresponds to the y-axis, and the normal direction of the xy plane thereof corresponds to the z-axis, is defined as (the length of the grain in the y-axis direction)/(the length of the grain in the y-axis direction) measured on the yz plane.

The measurement of the number of inclusions was performed by TEM, and the number of measured inclusions were analyzed by EDS. The TEM observation was performed in a randomly selected area with magnification in which inclusions of 0.01 μm or more were clearly observed, and in this case, the sizes and distribution of all inclusions were measured by photographing at least 100 images, and through the EDS spectrum, the types of the inclusions were analyzed.

In the cases of F2, F4, F6, and F7 included in the examples of the present invention, the annealing tension was 0.6 kgf/mm$^2$ or less during the annealing, and the ratio of the elongation grains of the tension direction was 1.5 or less, thus the high-frequency iron loss was excellent. However, unlike the examples of the present invention, when the annealing tension was 0.6 kgf/mm$^2$ or more during the annealing, the length direction elongation ratio increased, and the distribution density increased, thus 800 Hz iron loss was worse.

While the exemplary embodiments of the present invention have been described hereinbefore with reference to the accompanying drawings, it will be understood by those skilled in the art that various changes in form and details may be made thereto without departing from the technical spirit and essential features of the present invention.

Therefore, the embodiments described above are only examples and should not be construed as being limitative in any respects. The scope of the present invention is determined not by the above description, but by the following claims, and all changes or modifications from the spirit, scope, and equivalents of claims should be construed as being included in the scope of the present invention.

The invention claimed is:

1. A non-oriented electrical steel sheet comprising, based on 100 wt % of a total composition thereof, Ti at 0.0015 wt % or more to 0.0030 wt % or less, Nb at 0.0005 wt % or more to 0.0035 wt % or less, Vat 0.0015 wt % or more to 0.0040 wt % or less, B at 0.0003 wt % to 0.0020 wt %, and the remaining portion including Fe and impurities, wherein a value of ([Ti]+0.8[Nb]+0.5[V])/(10*[B]) is 0.4 to 7.8, wherein when a rolling direction of the electrical steel sheet corresponds to an x-axis, a width direction thereof corresponds to a y-axis, and a direction normal to an xy plane thereof corresponds to a z-axis, a value of (length of the grain in the y-axis direction)/(length of the grain in the z-axis direction) measured on a yz plane is 1.18 or more to 1.5 or less, and wherein the electrical steel sheet, based on 100 wt % of a total composition thereof, further includes P at 0.005 wt % to 0.08 wt %, Sn at 0.01 wt % to 0.08 wt %, Sb at 0.005 wt % to 0.05 wt %, or a combination thereof, and [P]+[Sn]+[Sb] is 0.01 wt % to 0.1 wt %.

2. The non-oriented electrical steel sheet of claim 1, wherein a grain size of the electrical steel sheet is 60 μm to 95 μm.

3. The non-oriented electrical steel sheet of claim 1, wherein the electrical steel sheet, based on 100 wt % of a total composition thereof, further includes C at greater than 0 to 0.004 wt % or less, Si at 2.5 wt % to 3.5 wt %, Al at 0.5 wt % to 1.8 wt %, Mn at 0.05 wt % to 0.9 wt %, N at greater than 0 to 0.0030 wt % or less, and S at greater than 0 to 0.0030 wt % or less.

4. The non-oriented electrical steel sheet of claim 1, wherein in the electrical steel sheet, the number of inclusions including Ti, Nb, V, and B is 500/mm$^2$ or less, wherein the measurement of the number of inclusions is performed by a transmission electron microscope (TEM), and the number of measured inclusions is analyzed by EDS.

* * * * *